US006065407A

United States Patent [19]

Wang

[11] Patent Number: 6,065,407

[45] Date of Patent: May 23, 2000

[54] LOCKING SLEEVE ASSEMBLY FOR A DISPLAY SHELF

[75] Inventor: Ken Wang, Chang Hua, Taiwan

[73] Assignee: Alltrend Co., Ltd., Chang Hua, Taiwan

[21] Appl. No.: 09/122,775

[22] Filed: Jul. 27, 1998

[51] Int. Cl.[7] ..... A47B 9/00

[52] U.S. Cl. ..... 108/147.13; 108/110; 211/187; 403/371

[58] Field of Search ..... 403/365, 367, 403/368, 371, 373, 334; 211/187; 108/107, 110, 147.13, 147.15, 147.17, 151; 248/245, 295.11

[56] References Cited

U.S. PATENT DOCUMENTS

| | | | |
|---|---|---|---|
| 3,424,111 | 1/1969 | Maslow | 108/147.13 |
| 4,128,064 | 12/1978 | Chung et al. | 108/147.13 X |
| 4,595,107 | 6/1986 | Welsch | 211/187 |
| 4,799,818 | 1/1989 | Sudimak et al. | 211/187 X |
| 5,174,680 | 12/1992 | Nakamura et al. | 403/371 X |
| 5,303,645 | 4/1994 | Maecham | 108/147.13 |
| 5,881,653 | 3/1999 | Pfister | 108/147.13 |

*Primary Examiner*—Harry C. Kim
*Attorney, Agent, or Firm*—Browdy and Neimark

[57] ABSTRACT

Improved locking sleeve assembly is intended for use on a knock-down display shelf which is made up of four supporting pillars, multiple inner sleeves, rest boards, a top board and a plurality of retaining caps. Each locking sleeve assembly is made up of a separable inner locking sleeve and a retaining cap which has a roundly flanged bottom and a hollow central tubular portion provided with a tapered inner surface. On the circular flange of each retaining cap are disposed a number of counter sunk screw holes. At each corner of a rest board is disposed a counter sunk through hole in which a bottom flanged retaining cap can be placed and fixed in place by screws engaged with the screw holes on the circular flange. Each supporting pillar has a plurality of equally spaced peripheral grooves so as to permit halves of the separable locking sleeves, each having a peripherally extended rib on the inner surface, to be selectively engaged with the grooves of a supporting pillar at various levels. Each retaining cap has a number of axial splits on the wall of its hollow central portion for permitting the retaining cap to be flexibly operated. In assembly, the locking sleeves are engaged with the 4 supporting pillars at different levels with every 4 sleeves located at the same level, then a rest board is engaged with the 4 supporting pillars with the counter sunk through holes, each having a retaining cap engaged therewith, of the rest board guided through the 4 supporting pillars. The tapered retaining caps can firmly and tightly engaged with the locking sleeves so as to support rest boards in place. To dismantle the display shelf, the splitted retaining caps are easily disengaged with the locking sleeves along with the rest boards.

2 Claims, 4 Drawing Sheets

LOCKING SLEEVE ASSEMBLY FOR A DISPLAY SHELF

BACKGROUND OF THE INVENTION

The present invention relates to improved locking sleeve assembly for use on a knock-down display shelf which is made up of four supporting pillars, multiple inner locking sleeves, rest boards, a top board and a plurality of retaining caps. Each locking sleeve assembly is made up of a separable inner locking sleeve and a retaining cap which has a roundly flanged bottom and a hollow central tubular portion provided with a tapered inner surface. On the circular flange of each retaining caps are disposed a number of counter sunk screw holes. At each corner of a rest board is disposed a counter sunk through hole in which a bottom-flanged retaining cap can be placed and fixed in place by screws engaged with the screw holes on the circular flange. Each supporting pillar has a plurality of equally spaced ring grooves so as to permit halves of the separable locking sleeves, each having a peripherally extended rib on the inner surface, to be selectively engaged with the grooves of a supporting pillar at various levels. Each retaining cap has a number of axial splits on the vertical wall of its hollow central portion for permitting the retaining cap to be flexibly operated when dismantled. In assembly, the locking sleeves are engaged with the 4 supporting pillars at different levels with every 4 sleeves located at the same level, then a rest board is engaged with the 4 supporting pillars with the counter sunk through holes, each having a retaining cap engaged therewith, of the rest board guided through the 4 supporting pillars. The tapered retaining caps can firmly and tightly engaged with the locking sleeves so as to support rest boards in place. To dismantle the display shelf, the splitted retaining caps are easily disengaged with the locking sleeves along with the rest boards.

Referring to FIGS. 1, 1A, 2, 2A, a conventional display shelf is made up of 4 supporting pillars 10, a plurality of locking sleeves 20 rest boards 30 and a top board 40. Each supporting pillar 10 is provided with a plurality of equally spaced ring grooves 11 and a soft pad 12 at the bottom end thereof. Each locking sleeve 20 is made up of two semi-tubular halves 21 each of which has an engagement recess 211 on an axial edge and a protruded lug 212 on the other axial edge so that two semi-tubular halves 21 can be bound together to form a tubular locking sleeve. Each half has a laterally extended rib 213 on the inner surface thereof which can be selectively engaged with a ring groove 11.

Each rest board 30 has a tapered through hole 31 at each corner thereof. The top board 40 has a round cavity 41 at each corner on its underside.

As shown in FIGS. 2, 2A, the assembly of such a display shelf is easily done by first mounting 4 locking sleeves 20 onto the 4 supporting pillars 10 at the same level. Two halves 21 of 4 locking sleeves 20 each having a curved lateral rib 213 on the inner face thereof are engaged with the supporting pillar 10 by way of the ring groove 11 at a selective level. Every two halves 21 of the locking sleeves 20 are interlocked together firmly by way of their corresponding recesses 211 and the protruded lugs 212 that are integrally engaged with each other after they are engaged with the selected ring groove 11 in assembly. Afterwards, the rest boards 30 are consecutively engaged with the supporting pillars 10 with the tapered through holes 31 in locking engagement with the locking sleeves 20, and the top board 40 is attached to the top end of the respective supporting pillars 40 by way of cavities 41 at the corners thereof.

Such conventional locking sleeves assembly used in a knock-down display shelf has a following disadvantage in practical use. Each tapered through holes 31 at the corners of a rest board 30 is in tight engagement with a locking sleeve 20 to avoid loose assembly of a display shelf. However, when the rest boards 30 are adjusted of the distances thereof, the tight engagement of the locking sleeves 20 and the tapered through holes 31, as shown in FIG. 2A, makes the disassembly of the display shelf difficult.

SUMMARY OF THE INVENTION

Therefore, the primary object of the present invention is to provide an improved locking sleeve assembly for use on a knock-down display shelf. Each locking sleeve assembly is comprised of a separable sleeve having a pair of semi-tubular halves and a retaining cap having a circular bottom flange and a number of axial splits on the vertical wall thereof. On the circular bottom flange are disposed a number of screw holes and each rest board of the display shelf is equipped with a counter sunk through hole at each corner thereof so as to permit a retaining cap to be fixed to each of the counter sunk through holes. The retaining caps having axial splits are easily disengaged from the locking sleeves when a display shelf is knocked down due to the axial splits of each retaining cap, making a display shelf easily adjusted of the distances of its rest boards.

DETAILED DESCRIPTION OF THE PREFERRED EMBODIMENT

Figures 1, 1A:
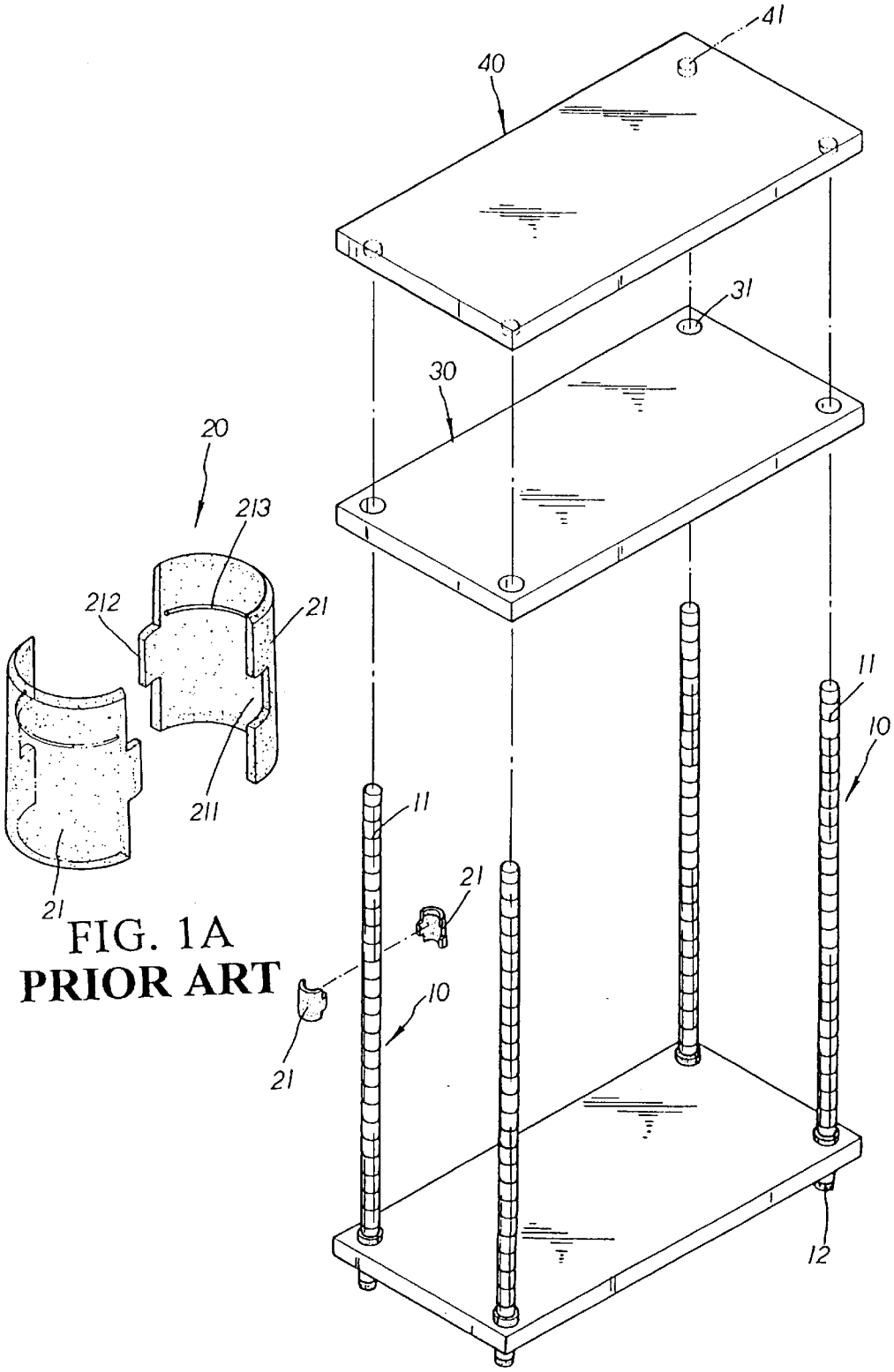
FIG. 1A PRIOR ART
FIG. 1 PRIOR ART
FIG. 1 is a diagram showing the exploded components of a prior art knock-down display shelf.
FIG. 1A is an enlarged diagram showing a conventional locking sleeve of the prior art knock-down display shelf.
Figure 2:
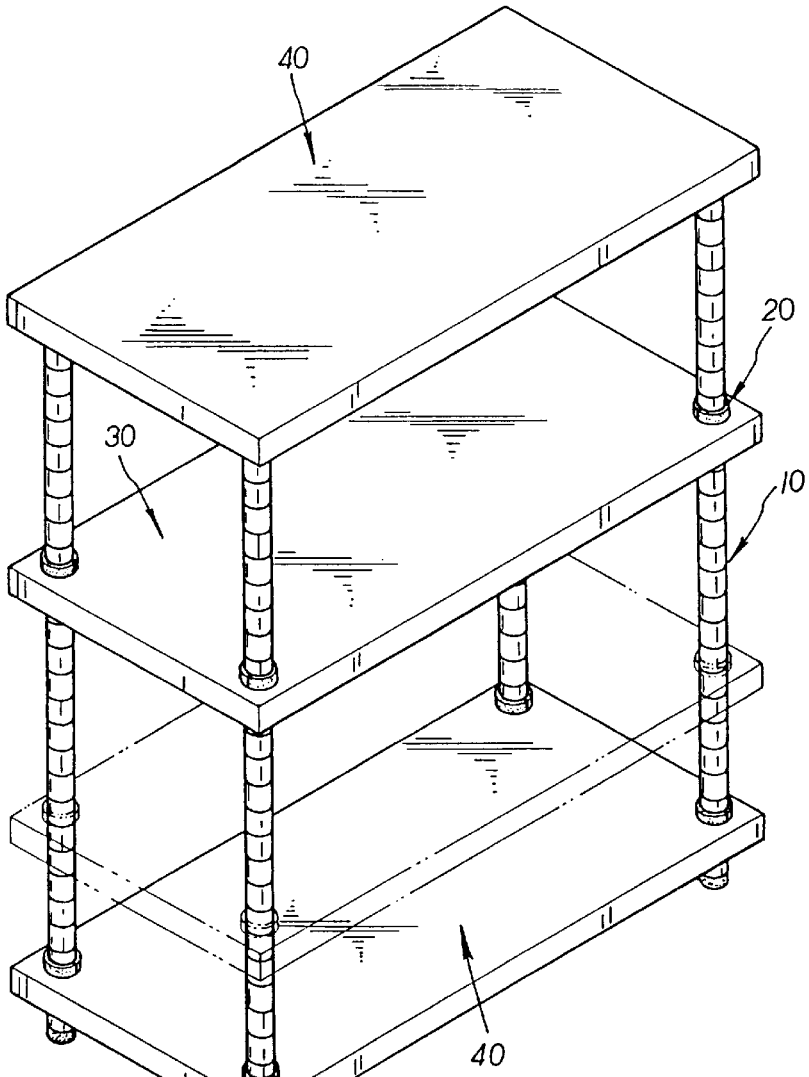
FIG.2 PRIOR ART
FIG. 2 is a diagram showing the assembly of the prior art display shelf.
Figure 2A:
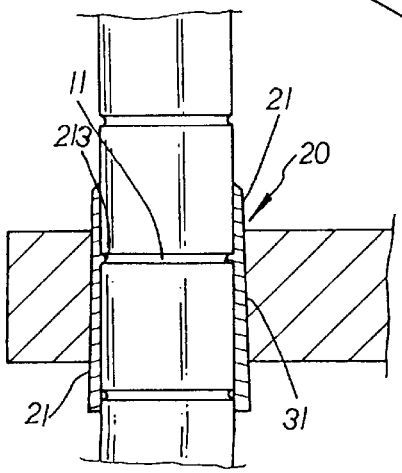
FIG. 2A PRIOR ART
FIG. 2A is a sectional diagram showing the practical use of the prior art locking sleeve.
Figure 3A:
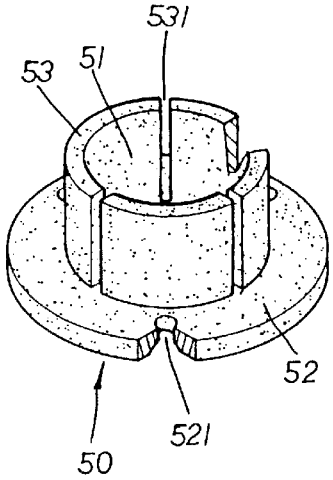
FIG. 3A is a diagram showing the enlarged retaining cap thereof.
Figure 3B:
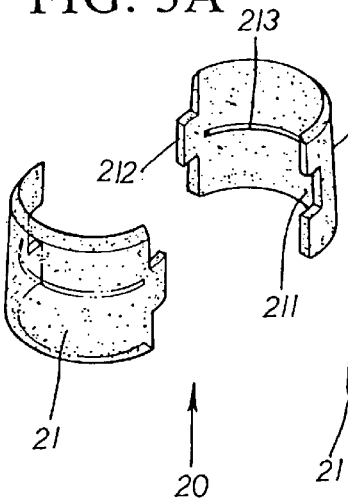
FIG. 3B is a diagram showing the separable locking sleeve thereof.
Figure 3:
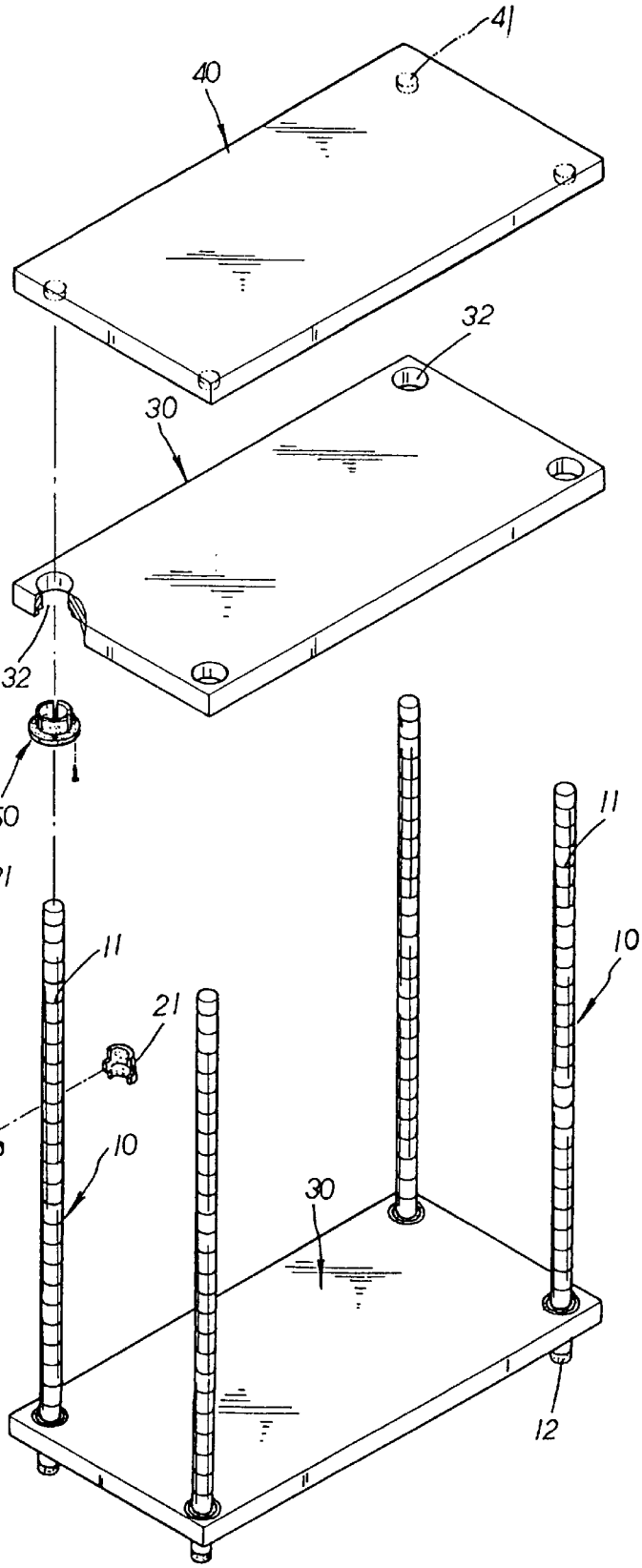
FIG. 3 is a diagram showing the exploded components of the present invention.
Figure 4:
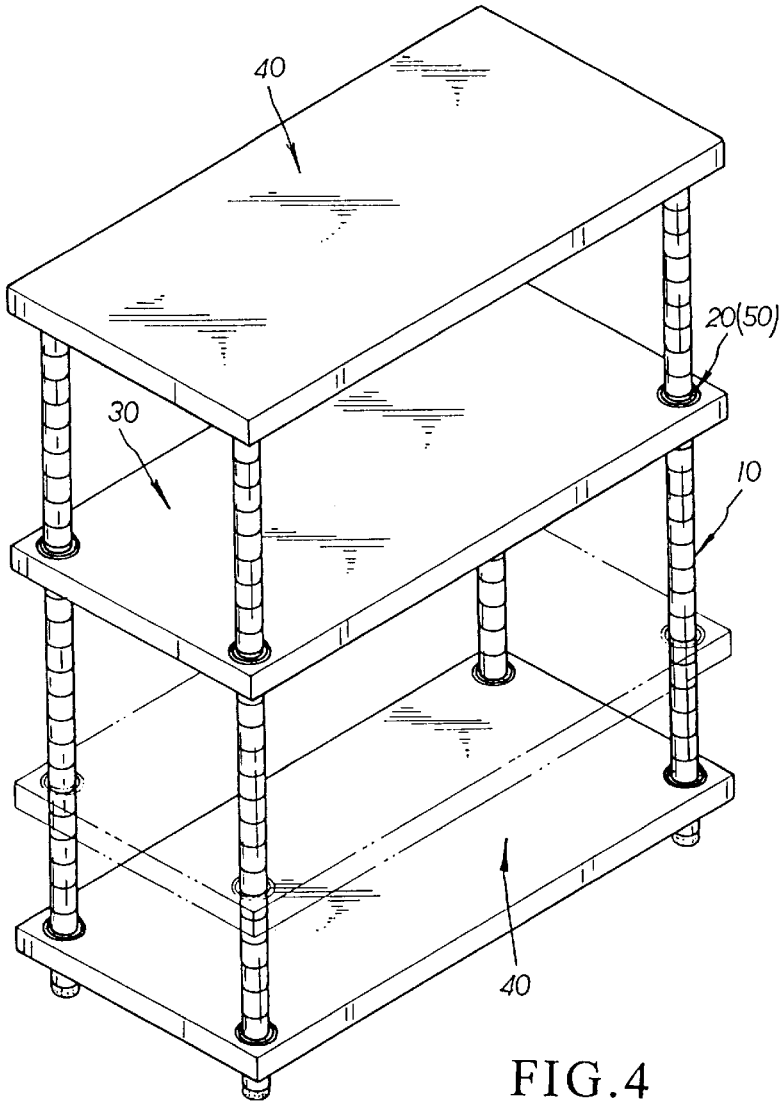
FIG. 4 is a diagram showing the assembled display shelf of the present invention by means of the retaining caps and locking sleeves.
Figure 4A:
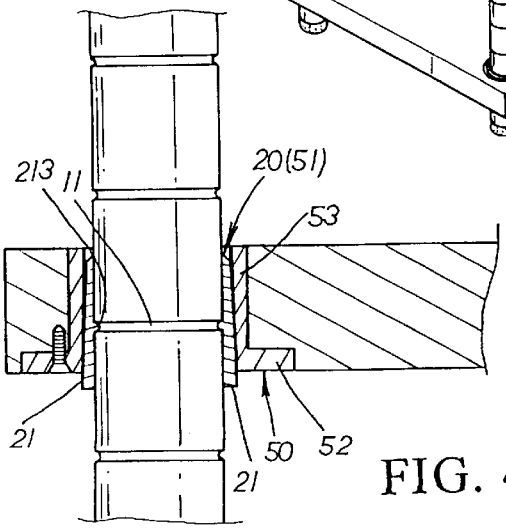
FIG. 4A is a sectional diagram showing the application of the retaining caps and sleeves of the present invention.

Referring to FIGS. 3, 3A, 3B, the display shelf is comprised of 4 supporting pillars 10, a plurality of separable locking sleeves 20, a number of rest boards 30 and a top board 40 and a plurality of retaining caps 50. Each supporting pillar 10 is provided with a plurality of equally spaced ring grooves 11 extending the full length thereof and a soft pad 12 at the bottom thereof.

Each locking sleeve 20 is made up of a pair of separable semi-tubular halves 21 each having slightly different thickness which increases from the top to the bottom edge thereof Each semi-tubular half 21 has an engagement recess 211 and a protruded lug 212 on the respective vertical edge thereof so that when a pair of halves are placed face to face, the semi-tubular halves 21 can be interlocked together by way of the engagement recesses 211 engaged with the corresponding protruded lugs 212 to form a locking sleeve 20.

At the middle of the inner face of each semi-tubular half 21 of the locking sleeve 20 is disposed a lateral limiting rib 213. Each rest board 30 has a counter sunk through hole 32 at every corner thereof. The top board 40 is provided with a mounting cavity 41 at each corner thereof.

The retaining cap 50 has a roundly flanged bottom 52 and a central hollow portion 51 and a vertical wall portion 53 which is tapered internally with its inner diameter gradually increased from top to bottom and also provided with a plurality of axial splits 531. On the bottom flange 52 of the retaining cap 50 are disposed a plurality of screw holes 521 which can be counter sunk in structure.

Each rest board 30 having a counter sunk through hole 32 at every corner thereof in which each retaining cap 50 can just be fitted and be secured in place by screws is mounted onto the four supporting pillars 10 one by one.

To secure a rest board 30 in place, four locking sleeves 20 each having a pair of semi-tubular halves 21 are selectively engaged with ring grooves 11 at a certain equal level by engaging the limiting ribs 213 of the two semi-tubular halves 21 with the ring grooves 11 and interlocking the same together by way of the protruded lugs 212 and the engagement recesses 211. Afterwards, the rest board 30 is pushed down with force to get the retaining cap 50 having a tapered inner face at each corner of the rest board 30 into locking engagement with the corresponding locking sleeve 20. To the top of the four supporting pillars 10 is at last mounted the top board 40.

To vary the position of a rest board 30, the rest board 30 is first pushed to move upward so as to free the retaining caps 50 having a tapered inner face from the restraint of the locking sleeves 20 secured to the supporting pillars 10 and embraced by the central hollow portion 51 of the retaining cap 50. Then the locking sleeves 20 are reinstalled at a newly selected position and the rest board 30 is re-mounted as described preceedingly.

It can be clearly seen that the present invention has an advantage given as follows. The internally tapered retaining caps 50 having a central hollow portion 51 can firmly engaged with the locking sleeves 20, free of shaky connection; and the axial splits 531 on the vertical wall portion 53 of the retaining cap 50 permits the locking sleeves 20 to be readily freed from the restraint of the central hollow portion 51 of the retaining cap 50 whereby the rest boards 30 can be easily disengaged from the supporting pillars 10 for position arrangement.

I claim:

1. A knock-down display shelf, comprising:

a locking sleeve including a pair of semi-tubular halves;

a retaining cap including a circular bottom flange and a tubular vertical wall forming a central hollow portion;

each said semi-tubular half including a limiting rib defined on an inner face thereof and including a protruded lug at one end and an engagement recess at the other end so as to permit said paired halves to be interlocked together in assembly;

said circular bottom flange of said retaining cap including a plurality of screw holes;

said tubular vertical wall of said retaining cap including a plurality of axial splits defined thereon and a tapered inner face;

said display shelf including a top board and a plurality of rest boards mounted in parallel onto four vertical supporting pillars;

said top board including a circular cavity at each corner thereof being mounted to a top end of said supporting pillars;

each said rest board including a countersunk through hole at each corner thereof so as to permit each said retaining cap to be fitted in and secured in place by screws in said countersunk through hole;

each said supporting pillar including a plurality of spaced ring grooves so as to permit one said locking sleeve to be selectively engaged with one of said ring grooves by way of the limiting rib of said semi-tubular halves that are interlocked together thereafter;

one said rest board being mounted onto said four supporting pillars with said locking sleeve being secured to each said supporting pillar at the same level so as to permit each said retaining cap housed in each said counter sunk through hole to be in tight engagement with a corresponding locking sleeve, free of shaky connection in assembly;

said axial splits of said retaining cap permitting said rest board to be readily disengaged from said locking sleeve when dismantled for position arrangement.

2. A knock-down display shelf, comprising:

a locking sleeve including a pair of semi-tubular halves;

a retaining cap including a circular bottom flange and a tubular vertical wall forming a central hollow portion;

each said semi-tubular half including a limiting rib defined on an inner face thereof and including a protruded lug at one end and an engagement recess at the other end so as to permit said paired halves to be interlocked together in assembly;

said circular bottom flange of said retaining cap including a plurality of screw holes;

said tubular vertical wall of said retaining cap including a plurality of axial splits defined thereon and a tapered inner face:

said display shelf including a top board and a plurality of rest boards mounted in parallel onto four vertical supporting pillars;

said top board including a circular cavity at each corner thereof being mounted to a top end of said supporting pillars;

each said rest board including a countersunk through hole at each corner thereof so as to permit each said retaining cap to be fitted in and secured in place by screws in said countersunk through hole;

each said supporting pillar including a plurality of spaced ring grooves so as to permit one said locking sleeve to be selectively engaged with one of said ring grooves by way of the limiting rib of said semi-tubular halves that are interlocked together thereafter;

one said rest board being mounted onto said four supporting pillars with said locking sleeve being secured to each said supporting pillar at the same level so as to permit each said retaining cap housed in each said counter sunk through hole to be in tight engagement with a corresponding locking sleeve, free of shaky connection in assembly;

said axial splits of said retaining cap permitting said rest board to be readily disengaged from said locking sleeve when dismantled for position arrangement;

wherein said screw holes on said circular bottom flange of said retaining cap are countersunk and are disposed between every two splits of said vertical wall of said retaining cap.

* * * * *